United States Patent [19]

Bohanszky

[11] 4,342,555

[45] Aug. 3, 1982

[54] SEALING APPARATUS

[75] Inventor: Victor A. Bohanszky, Fairview Park, Ohio

[73] Assignee: Davy Inc., Cleveland, Ohio

[21] Appl. No.: 175,727

[22] Filed: Aug. 6, 1980

[51] Int. Cl.[3] ..... F27B 7/24; F26B 25/00; F27D 1/18

[52] U.S. Cl. ..... 432/115; 34/242; 432/242

[58] Field of Search ..... 432/115, 242; 34/242

[56] References Cited

U.S. PATENT DOCUMENTS

| | | | |
|---|---|---|---|
| 1,550,951 | 8/1925 | Stone | 148/127 |
| 1,944,385 | 1/1934 | Wheeler | 277/22 |
| 2,292,778 | 8/1942 | Stack et al. | 277/128 |
| 3,575,397 | 4/1971 | McDowell | 34/242 |
| 3,700,220 | 10/1972 | Talago | 432/115 |
| 3,836,324 | 9/1974 | Shaefer et al. | 432/115 |

FOREIGN PATENT DOCUMENTS

| | | | |
|---|---|---|---|
| 244909 | 3/1912 | Fed. Rep. of Germany | 432/115 |
| 616509 | 7/1978 | U.S.S.R. | 432/115 |

*Primary Examiner*—John J. Camby

*Attorney, Agent, or Firm*—Bernard, Rothwell & Brown

[57] ABSTRACT

A seal for the ends of a rotary kiln or similar rotary device having a plurality of graphite blocks adapted to conform to the circular periphery of the kiln exterior. The graphite blocks are pressed gently against the shell by seal adjusting segments radially biased toward the center of rotation of the kiln. The seal adjusting segments are adjustably supported in a holder with a counterweighted rope circumscribing the seal adjusting segments to provide the biasing pressure and thereby hold the graphite blocks in sealing engagement with the kiln.

4 Claims, 3 Drawing Figures

SEALING APPARATUS

BACKGROUND AND DISCUSSION OF THE INVENTION

In rotary equipment such as kilns, driers, coolers, mills, trommels, etc. it is desirable to seal the internal hollow part of the equipment from the surrounding atmosphere. For example, in kilns there are often generated substantial amounts of heat and gases which could escape to the surrounding atmosphere if a seal about the rotary kiln were not provided. However, sealing rotary devices are characterized by some rather unique problems relating to countervailing considerations of rotation and sealing, since sealing usually is accompanied by a need for increased friction while rotation should have reduced friction. Thus, in providing the seal for a rotary kiln it is necessary to preferably enhance and at least not detract from rotation of the device due to friction imparted by the sealing mechanism.

Seals for such purposes have been provided before in the prior art, but these have been relatively complex in construction and operation. This complexity has raised the cost of initial construction as well as maintenance due to the difficulty in replacing seals. In addition, seals available heretofore have not been adjustable for dimensional variations in the periphery of the rotary equipment due to expansion and contraction from temperature changes, wear of the various elements, or runout of the rotary element.

The subject invention overcomes the problems which have constantly impaired the sealing mechanism for rotary equipment and particularly for equipment subjected to hot gases. Generally, the invention includes a plurality of graphite block segments circumscribing the periphery of the rotating element, for example a kiln, whereby the block segments are gently pressed against the shell by seal adjusting segments. Pressure is applied by the hoop tension generated by counterweighted rope wound completely around these segments. In this way the graphite block segments are biased against the peripheral surface of the rotating element while simultaneously accommodating changes in the surface of the kiln. For example, when the rotating element expands due to the increase in temperature, the graphite blocks will be moved radially outwardly against the hoop tension provided by the counterweighted rope. Conversely, during the cooling process where the drum will contract, the graphite blocks will move radially inwardly under the pressure, i.e. hoop tension, provided by the counterweighted rope to maintain the blocks continuously in contact with the outer surface of the rotatin kiln.

The use of a plurality of segments described above in conjunction with a specially configured holding mechanism facilitates replacement of individual segments without having to diassemble the entire sealing mechanism. Adjacent the area to be sealed, there is provided an outer stationary ring and an inner stationary ring spaced laterally apart from one another and circumscribing the periphery of the rotary kiln. Spacers fixed between the inner and outer rings maintain the desired space relationship while also providing for radial movement of the graphite blocks and holder segments carried between the spaced rings. The holder segments are slotted radially, and a bolt is passed through the slot and fixed to each of the rings. In this way the holder segment is maintained for radial movement, but prevented from lateral movement during rotation of the rotary kiln, to accommodate changes in the surface configuration of the kiln in the radial direction. The bottom portion of these segments is configured to restrain the graphite blocks from circumferential movement and for this purpose include extensions to grasp the graphite blocks on either end. When it is desired to replace one of these graphite blocks due to wear or damage, the bolt can simply be removed allowing initially the holder segment and subsequently the graphite block to be readily removed without interfering with the construction or placement of the other segments and blocks. A new segment and block are then bolted into place and the operation of the rotary equipment continued.

The sealing system of segments and blocks described above can be used with both the feed and discharge chutes. In addition, except for nominal leakage, this system can be applied to prevent either infiltration of outside air into the drum or escape of gases from within the drum depending on positive or negative pressure generation during operation of the kiln.

With the above construction sealing of the rotating equipment is accomplished simply and yet efficiently to maintain the seal between the surrounding atmosphere and the internal portions of the drum while providing easy replacement of the various segments without having to disassemble the entire mechanism. Furthermore, the graphite block can shift position to compensate for wear of the blocks and changes of the surface configuration of the rotating drum.

DETAILED DISCUSSION OF THE PREFERRED EMBODIMENT

Figure 1:
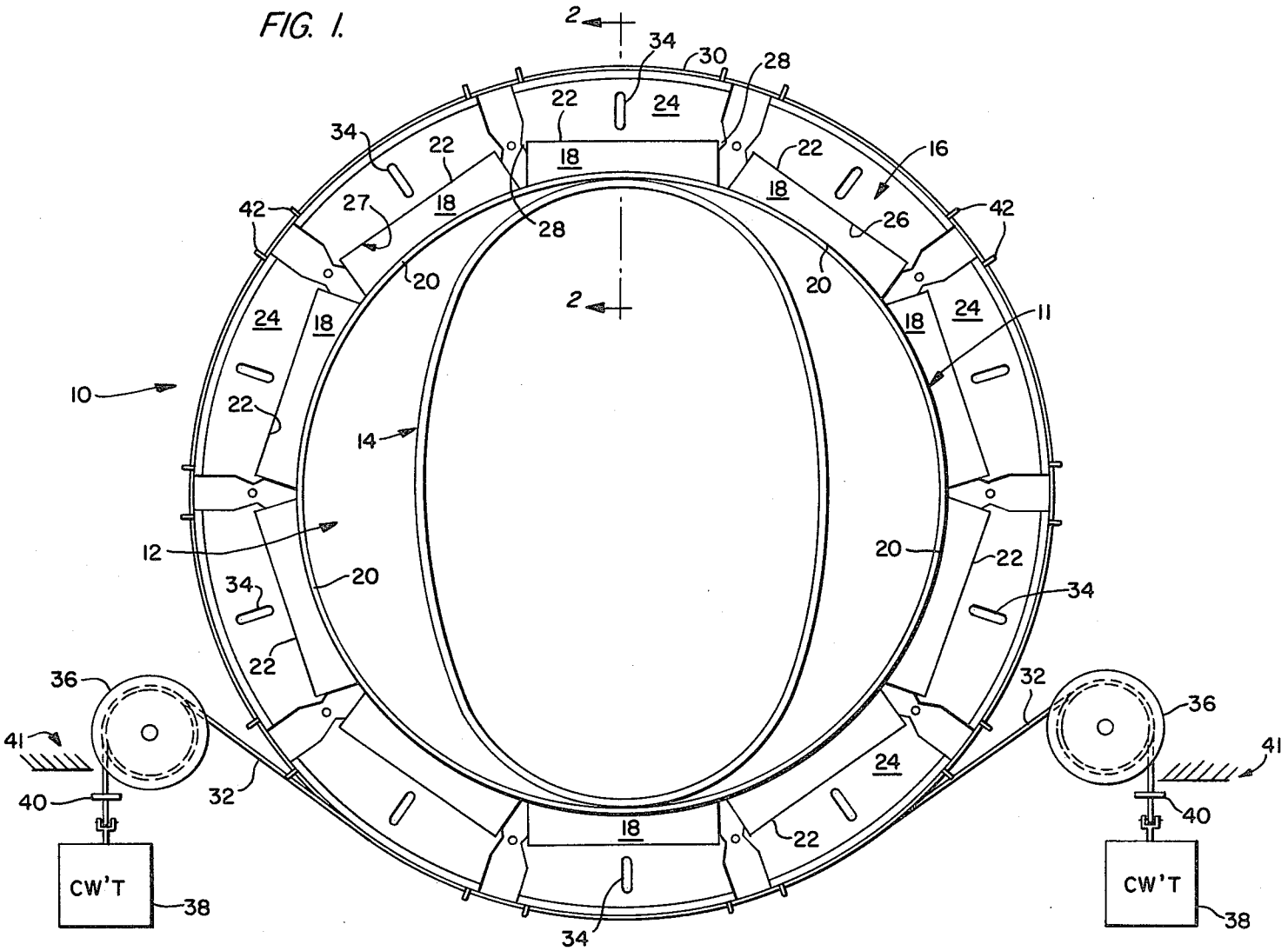
FIG. 1 shows an end view of a rotary kiln with the sealing mechanism of the invention.

Referring to FIG. 1, there is shown an end view of a rotary kiln employing the sealing mechanism of the invention. The rotary kiln and sealing assembly 10 includes the rotary drum or kiln 12 and a delivery chute 14 for receiving and delivering items to be baked or otherwise acted upon in the rotary kiln. Acting on the generally cylindrical rotary kiln 12 is sealing assembly 16 which completely circumscribes the outer periphery of the kiln 12 adjacent the delivery chute 14. The assembly 6 includes graphite blocks 18 with each block having an inner arcuate surface 20, of a radius of curvature substantially identical to that for the outer peripheral surface 11 of the kiln 12, and an outer flat surface 22 which cooperates with seal adjusting segments 24. The seal adjusting segments 24 act on the graphite blocks 18 under a bias pressure which will be described hereinafter to press the blocks and maintain them in constant engagement with the outer peripheral surface 11 of drum 12. In addition blocks 18 are restrained from circumferential movement but are provided with means for allowing radial movement both toward and away from the drum 12. For this purpose the segments are configured with an inner complementary surface 26 for engaging the outer flat surface 22 of the blocks. The complementary surface is in the form of a channel 27 having channel sides 28 at either end of the channel to engage sides 29 of the graphite blocks 18, as can be seen more clearly in FIG. 3, and prevent movement of the graphite blocks in a circumferential direction.

Figure 2:
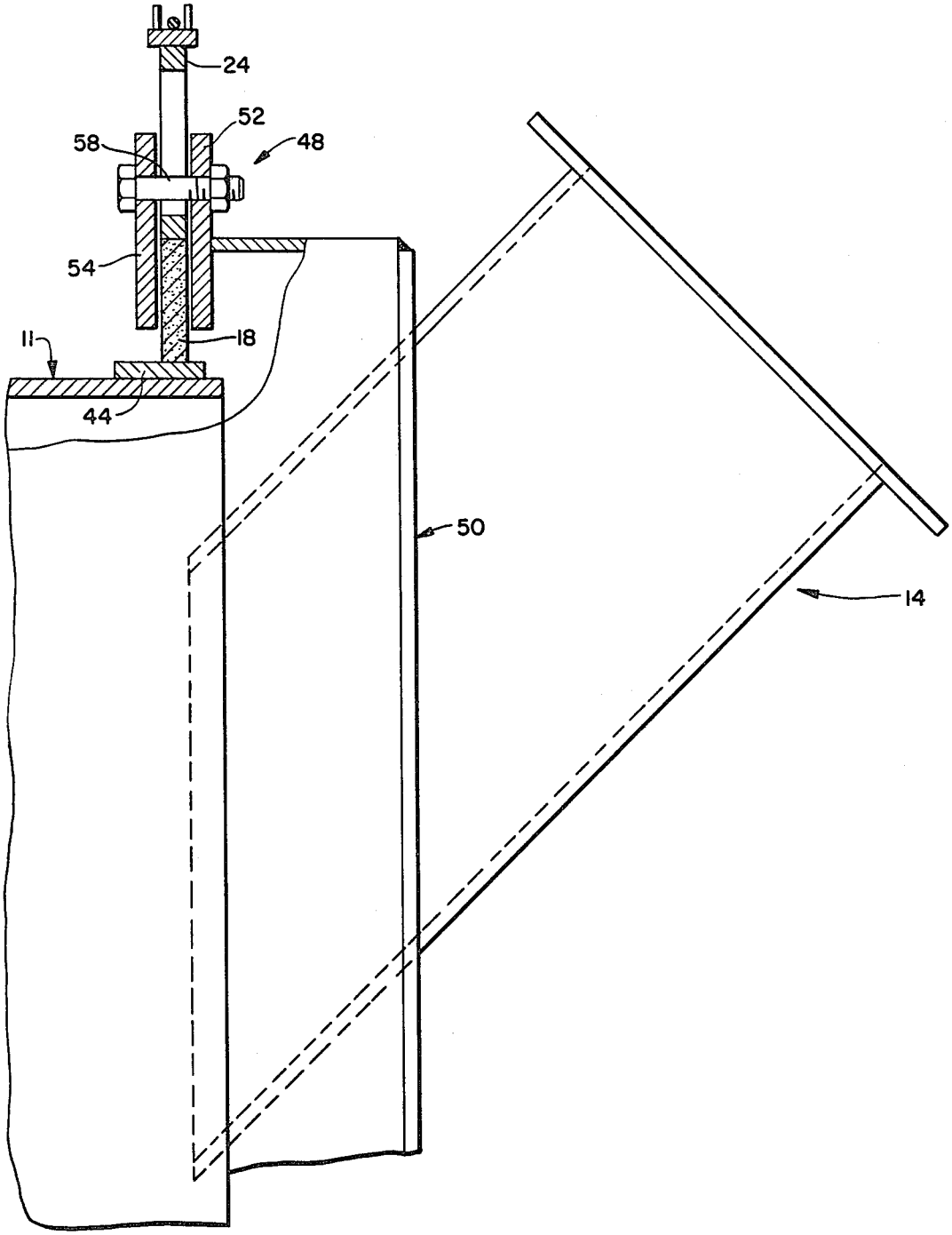
FIG. 2 shows a cross-sectional view of FIG. 1 taken along section lines 2—2.

For maintaining a slight radial pressure against the blocks, an elongate flexible member under tension, such as a rope, completely circumscribes the plurality of seal adjusting segments 24. Each segment includes an outer arcuate surface 30 configured to receive and hold the rope 32 for this purpose. As shown the outer arcuate surface 30 on segments 24 defines a rope support member having upstanding therefrom pins 42 on each segment to prevent the rope from slipping off these segments during operation of the rotary kiln. As shown in FIGS. 1 and 2 each segment 24 has two spaced pins 42 at each end, although a convenient number of pins can be employed for this purpose. Alternatively, the outer arcuate surface 30 could be grooved circumferentially to retain the rope within the segments during the operation of the kiln.

Two pulleys are provided, one for each side of the rotary kiln as can be seen in FIG. 1, for sheaving of the ends of the rope thereabout to hold weights 38 at the rope ends. The rope 32 is overlapped on the bottom portion of the rotary kiln between the pulleys 36. This assures that the entire circumference of the sealing mechanism is under the radial tension supplied to the rope by the weights 38. The ends of rope 32 are wrapped about the pulleys 36 to facilitate attachment of the weight to the rope ends and accommodate movement in the radial direction of the seal adjusting segments 24 due to variations in the surface of the drum 12. Conversely, contraction reduces the circumferential dimension allowing the rope 32 to be moved away from the rotary drum toward the sheave due to the downward force of the weights 38.

Adjacent each weight there is provided rope stop 40 such that, where the expansion for example causes the rope 32 to be pulled toward the rotary drum as a result of the increased circumferential dimension thereby pulling the weights 38 upwardly, the stop will prevent the weights 38 from being pulled about sheave 36. For this purpose, the pulleys 36 are located adjacent rigid structural members 41 for engagement by stops 40. Due to differences in weight one of the weights 38 may eventually creep upwardly, relative the other weight, closer to its respective pulley 36. As a result during thermal expansion of the rotary kiln there would be a tendency for the closer weight 38 to contact its pulley 36, but, as can be seen in FIG. 1, this contact will be prevented by engagement to stop 40 with structural member 41. When one stop 40 is engaged with member 41 any further expansion of the rotary kiln will be accommodated entirely by movement of the other weight.

With this system a constant tension is placed on the blocks 18 entirely about the periphery of rotary drum 12 insuring a satisfactory seal while maintaining friction to a minimum. Since the blocks 18 are composed of graphite, radial pressure can be applied for sealing purposes, while the lubricating effect of the graphite enhances rotation. The ability of the rope to accommodate the seal adjusting segments as described above results in an automatically self-adjusting system to maintain the seal without detriment to the operation of the rotary kiln.

A fixed holder assembly 48 is provided to maintain the self-adjusting segments 24, graphite blocks 18 and rope 32 in the proper disposition relative to drum 12. This holder assembly 48 includes a front circular plate 50 which covers the entire front or end portion of the drum 12 except for the delivery chute. An outer annular plate 52 completely circumscribes the periphery of the drum 12 spaced from the outer-most surface of the drum and is fixed to the holder assembly 48 to provide a fixed support structure for other elements to maintain graphite blocks 18 and seal adjusting segments 24 in the proper position as described above. An inner annular plate 54 of approximately the same dimensions as the outer annular plate 52 is fixed in spaced relationship to the outer annular plate 52 also about the periphery of the drum 12. Spacers 56 are maintained or secured equidistantly about the entire circumference of the inner and outer plates 52 and 54 respectively to maintain them in the proper space relationship which is at least equal to and preferably slightly greater than the width of the seal adjusting segments 24 and the graphite blocks 18. Bolts 58 secure the two plates together and extend through radial slot 34 provided in the segments 24 to fix the outer annular plate 52 to the fixed assembly 48 and restrain the segments 24 from movement in the circumferential direction while providing for movement in the radial direction.

The slots 34 in the segments 24 extend in a radial direction at least equal to and preferably slightly greater than the distance expected for wear or expansion and contraction of the graphite blocks 18 during normal operation of the rotary kiln. The width of the slots is only slightly greater than that of the bolts to restrain these segments from circumferential movement. As explained before, since the segments have channel sides 28 to engage the sides of the blocks 18, restraint of the segments 24 by the bolts 58 results in a corresponding restraint of the graphite blocks.

This configuration also provides or facilitates easy maintenance for worn or damaged graphite blocks. For example should a block 18 be worn, as shown in FIG. 2 the bolt 58 can simply be removed after the rope has been lifted off the peripheral surface. Once the bolt is removed the segment can simply be pulled radially from its position allowing the graphite block to be similarly removed. A new graphite block 18 is then placed in the proper position and the adjusting segment 24 is then placed over the new graphite block with the outer flat surface 22 of the block 18 fitting into the channel sides 28 of the adjusting segment 24. The bolt is then simply reinserted and fixed into place by tightening of the nut as shown.

It should also be noted with respect to FIG. 2 that a complementary peripheral surface on drum 11 can be provided for engagement with the graphite block 18. As shown a circular rim 44 which extends about the entire periphery of the drum 12 is located relative to the blocks that it can be engaged by the graphite blocks during operation of the kiln. By having complementary surfaces of this sort the sealing relationship between the elements is enhanced.

Figure 3:
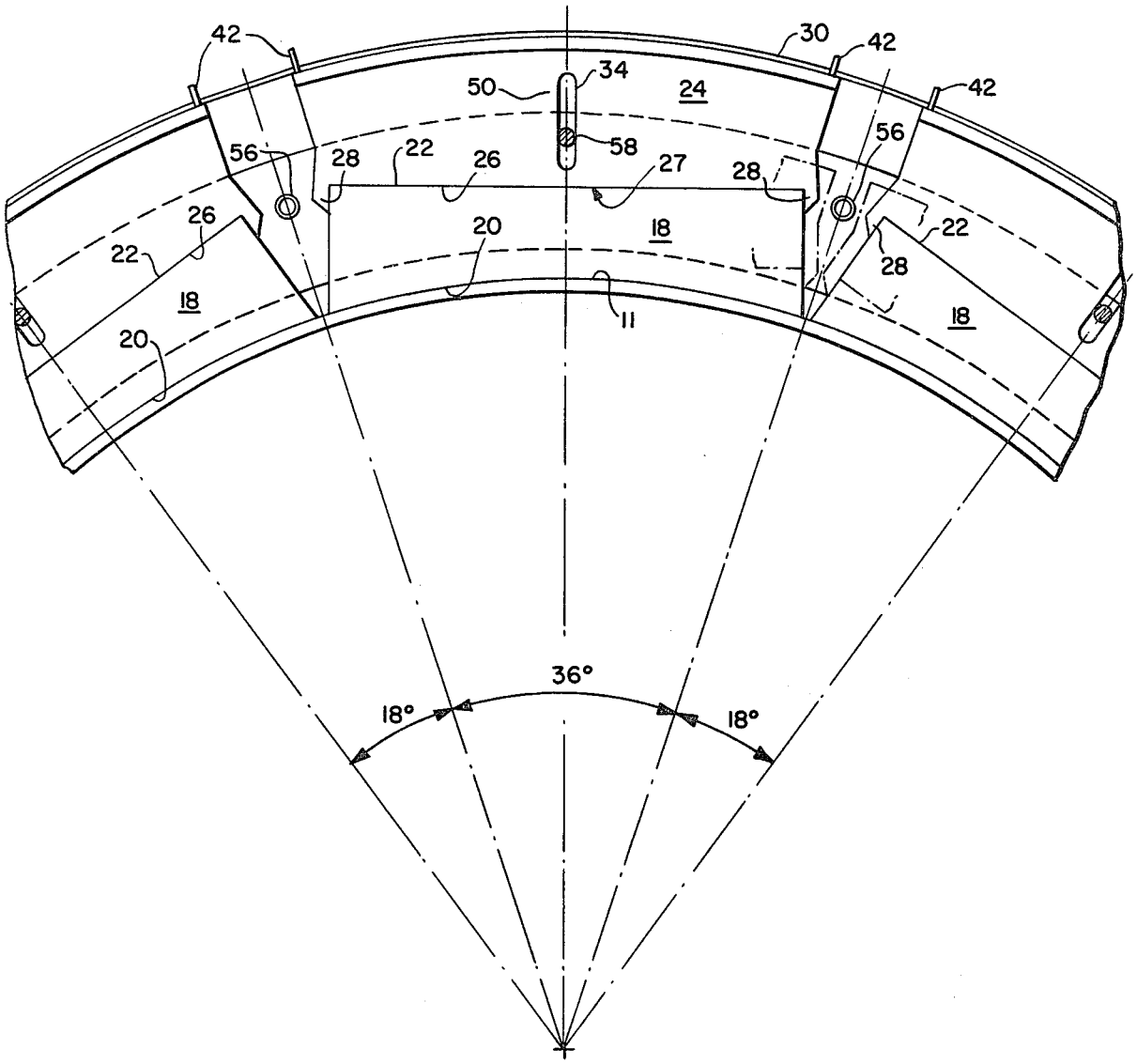
FIG. 3 shows an enlarged partial view of FIG. 1 showing the detail of the seal adjusting segments and the graphite blocks.

It should also be noted that blocks 18 are specially configured to provide a seal between the blocks 18 and rim 44. Each block 18 has end surfaces at an angle to the radial, as can be seen in FIG. 3, to provide a diverging configuration toward the center of the rotating drum. In this manner, the inner arcuate surface 20 is of a greater dimension or length than the outer square surface 22. As a result at least in the normal position a slight space is left between adjacent blocks 18 where they engage the outer peripheral surface of the drum 12, and the space increases in width as one moves radially away from the drum. With this configuration, movement toward and away from the drum by blocks 18 can be accomplished without interference among adjacent blocks.

As shown, the length of the arc for the graphite blocks 18 is approximately 36° for any given size drum. Of course this is a dimension chosen for the preferred embodiment, but any number of graphite blocks could be used either lesser or greater of those shown herein while still achieving the advantages discussed.

With the above system it can be seen that the seal is maintained between the opening in the drum and the surrounding atmosphere with sufficient flexibility to adjust for changes automatically in the circumference of the drum 12. In addition, the replacement of worn graphite blocks can be accomplished without having to remove the entire sealing mechanism. This system while shown with a rotating kiln can be employed with other rotating drum-like apparatus where an effective seal is required.

The above has been a description of the preferred embodiment of applicant's invention and is not intended to in any way limit the scope of protection applicant may be entitled. Rather this scope is better defined in the claims that follow.

I claim:

1. An apparatus for sealing a rotary member comprising:

a rotary member having an opening in one end thereof for charging and discharging material, therethrough, a plurality of graphite blocks circumscribing said rotary member and engaging the periphery of said rotary member, said blocks acting to seal said opening from the surrounding atmosphere, said plurality of blocks having an internal surface with a radius of curvature substantially identical to the radius of curvature of said periphery of said rotary member;

biasing means for biasing said blocks radially inwardly against said rotary member and for permitting movement radially outwardly from said rotary member to conform to changes in the surface of said rotary member;

said biasing means including a rope having two ends, said rope overlapping over a portion of said blocks, spaced apart sheaves, weights attached to each end of said rope, said rope being looped about said sheaves such that hoop tension is constantly maintained on said blocks during movement toward and away from said rotary member by said blocks and corresponding movement of said rope is accommodated by raising and lowering of said weights;

a plurality of segments for engaging corresponding ones of said plurality of graphite blocks for holding said blocks against the periphery of said rotary member, each of said segments having an inner surface for engaging a corresponding one of said graphite blocks and an outer surface for engagement by said rope;

an inner ring circumscribing said rotary member, an outer ring circumscribing said rotary member and spaced laterally from said inner ring, said graphite blocks and said segments being held between said inner and said outer rings about the periphery of said rotary member;

spacers extending between said inner ring and said outer ring to maintain said rings in said spaced relationship while providing for a radial movement of said segments and said graphite blocks;

said segments being adjustably secured to said rings for engaging said graphite blocks and for restraining circumferential movement of said blocks about the periphery of said rotary member; and each of said segments including a radial slot for engagement by a bolt between said inner and said outer rings, said slot being of sufficient length to provide for radial movement due to changes in the peripheral surface of said rotary member.

2. The apparatus according to claim 1 wherein said slot is dimensioned to engage said bolt whereby substantial circumferential movement of said segments is prevented.

3. The apparatus according to claim 2 wherein said outer ring is fixed relative to said rotary kiln and said inner ring is secured to said outer ring by said bolts and said spacers.

4. An apparatus for sealing a rotary member comprising:

(a) a rotary member having an opening in one end thereof for charging and discharging material therethrough, a plurality of blocks circumscribing said rotary member and engaging the periphery of said rotary member, said blocks acting to seal said opening from the surrounding atmosphere;

(b) means for biasing said blocks radially against said rotary member including a rope having two ends, said rope overlapping over a portion of said blocks, spaced apart sheaves, weights attached to each end of said rope, said rope being looped about said sheaves such that hoop tension is constantly maintained on said blocks during movement toward and away from said rotary member by said blocks and corresponding movement of said rope is accommodated by raising and lowering of said weights;

(c) a plurality of sements for engaging corresponding ones of said plurality of blocks for holding said blocks against the periphery of said rotary member, each of said segments having an inner surface for engaging a corresponding one of said graphite blocks and an outer surface for engagement by said rope;

(d) said inner surface of each of said segments having a channel configuration with channel sides to engage sides of corresponding blocks to prevent movement of the blocks in a circumferential direction; and (e) each of said segments having a radial slot for engagement with a fixed member extending through said slot to provide for radial movement due to changes in the peripheral surface of said rotary member while preventing substantial circumferential movement of said segments.

* * * * *

UNITED STATES PATENT OFFICE

CERTIFICATE OF CORRECTION

Patent No. 4,342,555 Dated August 3, 1982

Inventor(s) Victor A. Bohanszky

It is certified that error appears in the above-identified patent and that said Letters Patent are hereby corrected as shown below:

On the title page
After the word "Assignee:", "Davy Inc." should be

--Davy McKee Corporation--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*